US007161493B2

(12) United States Patent
Itou et al.

(10) Patent No.: US 7,161,493 B2
(45) Date of Patent: Jan. 9, 2007

(54) BRUSH ABRASION DETECTOR OF VEHICLE GENERATOR

(75) Inventors: Yoshihito Itou, Tokyo (JP); Shiro Iwatani, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 101 days.

(21) Appl. No.: 10/826,292

(22) Filed: Apr. 19, 2004

(65) Prior Publication Data

US 2005/0122227 A1 Jun. 9, 2005

(30) Foreign Application Priority Data

Dec. 3, 2003 (JP) ..... P2003-405009

(51) Int. Cl.
*G08B 21/00* (2006.01)

(52) U.S. Cl. ..... 340/648; 340/679; 340/664; 340/686.1; 310/242

(58) Field of Classification Search ..... 340/648, 340/679, 686.1, 664; 310/245, 242, 249, 310/168, 239; 218/610, 660; 200/61.41
See application file for complete search history.

(56) References Cited

U.S. PATENT DOCUMENTS 3,523,288 A * 8/1970 Thompson ..... 340/648
3,728,565 A * 4/1973 O'Callaghan ..... 310/168
4,024,525 A * 5/1977 Baumgartner et al. ..... 340/648
4,316,186 A * 2/1982 Purdy et al. ..... 340/648
4,528,556 A * 7/1985 Maddox ..... 340/648
4,636,778 A * 1/1987 Corkran et al. ..... 340/648
4,959,577 A * 9/1990 Radomski ..... 310/263
6,838,803 B1 * 1/2005 Kiyota ..... 310/242

FOREIGN PATENT DOCUMENTS

| | | |
|---|---|---|
| JP | 139408/1980 | 3/1979 |
| JP | 44404/1982 U | 3/1982 |
| JP | 57-101549 A | 6/1982 |
| JP | 58-063053 A | 4/1983 |
| JP | 7661/1985 U | 1/1985 |
| JP | 24379/1994 U | 3/1994 |

* cited by examiner

*Primary Examiner*—Anh V. La
(74) *Attorney, Agent, or Firm*—Sughrue Mion, PLLC

(57) ABSTRACT

The brush abrasion detector is unnecessary to provide any detecting element for detecting limit of abrasion of a brush in the proximity of the brush. The brush abrasion detector includes: a brush located being slidably press-fitted to a slip ring provided at an end portion of a field winding of a generator, and supplying an excitation current from a battery to the field winding; a current detection circuit for detecting a current value flowing through the field winding via the brush; an output voltage detection circuit for detecting an output voltage value from the generator; and a brush abrasion determination circuit for determining abrasion state of the brush based on a current value detected by the current detection circuit or an output voltage value detected by the output voltage detection circuit.

15 Claims, 11 Drawing Sheets

(a)

| BRUSH ABRASION DETERMINATION CIRCUIT | OUTPUT VOLTAGE DETECTION CIRCUIT REVOLUTION SPEED DETECTION CIRCUIT | POWER SUPPLY TRIGGER CIRCUIT | PL DRIVE CIRCUIT |
|---|---|---|---|
| — | — | 0 | — |
| — | — | 0 | — |
| 0 | 0 | 1 | 1 |
| 0 | 1 | 1 | 0 |
| — | — | 0 | — |
| — | — | 0 | — |
| 1 | 0 | 1 | 1 |
| 1 | 1 | 1 | 1 |

(b)

| | OPERATION | |
|---|---|---|
| LOGICAL VALUE | 1 | 0 |
| BRUSH ABRASION DETERMINATION CIRCUIT | LIGHTING WHEN BRUSH ABRASION ALARM FLICKERING | NOT REACHED BRUSH ABRASION LIMIT LIGHT-OUT WHEN BRUSH ABRASION ALARM FLICKERING |
| OUTPUT VOLTAGE DETECTION CIRCUIT REVOLUTION SPEED DETECTION CIRCUIT | NOT LESS THAN OUTPUT VOLTAGE THRESHOLD NOT LESS THAN ENGINE SPEED THRESHOLD | GENERATOR GENERATES NO POWER ENGINE ROTATION STOPPED |
| POWER SUPPLY TRIGGER CIRCUIT | KEY SWITCH ON | KEY SWITCH OFF |
| PL DRIVE CIRCUIT | LAMP LIGHTING | LAMP LIGHT-OUT |

Fig. 8

BRUSH ABRASION DETECTOR OF VEHICLE GENERATOR

BACKGROUND OF THE INVENTION

1. Field of the Invention

The present invention relates to a brush abrasion detector of a vehicle generator to be mounted on a vehicle such as automobile, auto-truck, electric train or the like.

2. Description of the Related Art

FIG. 11 is a diagram showing arrangement of a conventional brush abrasion detection circuit that detects a limit of abrasion of a brush in a vehicle AC generator, and raises the alarm for the detected limit and displays it, which is an art disclosed, for example, in the Japanese Patent Publication (unexamined) No. 101549/1982.

Operation of the conventional brush abrasion detection circuit, shown in FIG. 11, is described.

When a key switch 105 is closed, an excitation current flows from a battery 104 through the key switch 105, a brush (+) 109, a field winding (also referred to as a rotator winding) 102, a brush (−) 110 and a power generation control device 108. This current brings the field winding 102 in DC excitation (first control mode).

In such a state, when the rotator winding 102 is rotated and driven due to rotation of an engine not shown, voltage is induced to an armature winding (also referred to as a rotator winding) of three-phase star connection. Power generation output therefrom charges the battery 104 via a three-phase full-wave rectifier 103, while an excitation current flows from an auxiliary rectifier 107 to the field winding 102.

As a result, current flowing through a PL (pilot lamp) 106 is caused to reduce, and the PL (pilot lam) 106 having been in the state of lighting is turned off, whereby a vehicle driver can know the fact that a generator is in the state of power generation.

When rotational speed of the field winding 102 increases further, the power generation control device 108 is switched to a second control mode to control an excitation current flowing through the field winding 102 in order to make voltage of the battery 104 constant.

At this time, when either of the brush (+) 109 or brush (−) 110, which supplies current to the field winding 102, approaches the limit of abrasion, and the supply of excitation current is stopped, the power generation is stopped as well.

The foregoing conventional brush abrasion detector is provided with a photoelectric detector, e.g., a projector 113 and a photo-receiver 114 acting as a brush abrasion limit detecting part in the proximity of the brush (+) 109 and the brush (−) 110.

When the brush (+) 109 or the brush (−) 110 moves to a predetermined position due to abrasion, the photo-receiver 114 receives light from the projector 113, and carries out photoelectric transfer, thereby detecting a limit of abrasion of the brush.

FIG. 12 is a view showing a state in which the brush acting as a power feed member for use in the conventional abrasion detection circuit is held. For example, the brush (+) 109 is pressed onto a part that is fed with an electric power, not shown, by e.g., a coil spring 126. This brush (+) 109 is arranged to move as a whole due to abrasion of the brush (+) 109 itself while keeping the power feed.

The projector 113 (such as LED) and the photo-receiver 114 (such as photo transistor) are located in opposition to each other via a space in which the brush (+) 109 is held as shown in FIG. 12. The brush (−) 110 is located in a like manner.

In addition, the brush holder 125 being provided with the projector 113, the photo-receiver 114 and the coil spring 126, holds the brush 109 movably in the state of being press-fitted to an internal space thereof.

As a result, normally the brush is interposed between the projector 113 and the photo-receiver 114, and the photo-receiver 114 receives no light. However, as the brush approaches the limit of abrasion, the photo-receiver 114 comes to receive the light from the projector 113 increasingly. Additionally, FIG. 12 shows the state of receiving the light.

Current flows through the photo-receiver 114 responsive to the fact that the photo-receiver 114 receives the light, and then a transistor 115 amplifies this current and a Zener diode 118 brings it into a constant voltage.

Then, this constant voltage serves as an operation power supply for an astable multi-vibrator 112.

On the other hand, as an input to the foregoing astable multi-vibrator 112, the current having made the transistor 116 in ON state from a neutral point 111 via a diode 119 and a resistor 124, flows to the astable multi-vibrator 112 via a resistor 123.

The transistor 116 comes to be in the state of on (ON) or off (OFF) in accordance with a low level or a high level of the astable multi-vibrator 112, and further a transistor 117 comes to be in ON/OFF state. The PL (pilot lamp) 106 lights only when the transistor 117 is in ON state.

Accordingly, when the brush (+) 109 or the brush (−) 110 approaches the limit of abrasion, the astable multi-vibrator 112 oscillates at a low frequency, whereby the PL (pilot lamp) 106 comes to be in the state of a periodic flickering, that is, in the state of detecting and displaying the limit of abrasion.

In addition, as another conventional method for detecting the limit of abrasion of brush, the following brush abrasion detector is proposed in the Japanese Laid-open Utility Model Publication No. 44404/1982. In this detector, a brush, in which a detection electrode is implanted up to a position where the abrasion of brush is allowable, is attached so that a lower end face of the brush may be in contact with a commutator of an electric rotating machine, and alarm means is connected between the detection electrode and a power supply for the electric rotating machine. In response to the fact that the detection electrode is brought in contact with the commutator due to abrasion of brush, a predetermined voltage is applied to the alarm means to give an alarm.

However, in the conventional device (brush abrasion detection circuit) proposed in the Japanese Patent Publication (unexamined) No. 101549/1982, a detector consisting of a projector (light emitting diode), a photo-receiver (photo transistor) and the like is required in order to detect the abrasion of brush. Moreover, to dispose these detectors at a brush holder, it is necessary to apply machining to the brush holder.

In the conventional brush abrasion detector proposed in the Japanese Laid-open Utility Model Publication No. 44404/1982, although no detector consisting a projector and a photo receiver is required, it is necessary to implant directly in the brush a detection electrode for detecting the limit of abrasion thereof. Therefore, application of complicated machining is necessary as well.

Moreover, in the above-described conventional device, normally scrap or dust of abrading brush are produced and accumulated accompanied by the abrasion of brush.

Consequently, the accumulated scrap or dust becomes a factor of reducing operation reliability of a detector or detecting element disposed in the proximity of the brush at the time of the limit of abrasion of brush.

SUMMARY OF THE INVENTION

The present invention was made to solve above-discussed problems, and has an object of providing a brush abrasion detector of a vehicle generator of a superior productivity at a reasonable cost, in which it is not necessary to provide any detecting element for detecting the limit of abrasion of a brush in the proximity of the feed mechanism section or at the brush itself, thus no machining being required in order to provide a detecting element.

Another object of the invention is to provide a highly reliable brush abrasion detector of a vehicle generator capable of preventing decrease in reliability of detecting the limit of abrasion of brush caused by scrap or dust of the abrading brush or the accumulation thereof.

A brush abrasion detector of a vehicle generator according to the present invention includes: a brush that is located being slidably press-fitted to a slip ring, which is provided at an end portion of a field winding of a generator, and supplies an excitation current from a battery to the mentioned field winding; a current detection circuit for detecting a current value flowing through the mentioned field winding of the generator via the mentioned brush; an output voltage detection circuit for detecting an output voltage value from the mentioned generator; and a brush abrasion determination circuit for determining an abrasion state of the mentioned brush based on a current value detected by the mentioned current detection circuit or an output voltage value detected by the mentioned output voltage detection circuit.

Another brush abrasion detector of a vehicle generator includes: a brush that is located being slidably press-fitted to a slip ring, which is provided at an end portion of a field winding of a generator, and supplies an excitation current from a battery to the mentioned field winding; a revolution speed detection circuit for detecting the number of revolutions of the mentioned generator; and a brush abrasion determination circuit determining an abrasion state of the mentioned brush based on the number of revolutions detected by the mentioned revolution speed detection circuit.

Accordingly, in this invention, it is possible for a control circuit section of the generator to have therein a function to detect the limit of abrasion of brush.

As a result, it is unnecessary to provide any detecting element for detecting the limit of abrasion of brush in the proximity of the feed mechanism section or at the brush itself, thus no machining being required in order to provide a detecting element, thereby enabling to provide a brush abrasion detector of a vehicle generator of a superior productivity at a reasonable cost.

Furthermore, since no detecting element for detecting the limit of abrasion of brush is provided in the proximity of the brush, it is possible to provide a highly reliable brush abrasion detector of a vehicle generator capable of preventing the decrease in reliability of detecting the limit of abrasion of the brush caused by scraps or dust of the abrading brush or the accumulation thereof.

The foregoing and other object, features, aspects and advantages of the present invention will become more apparent the following detailed description of the present invention when taken in conjunction with the accompanying drawings.

BRIEF DESCRIPTION OF THE DRAWINGS

FIGS. 8(*a*) and (*b*) are tables for explaining an operation state of a primary circuit.

DETAILED DESCRIPTION OF THE INVENTION

Figure 1:
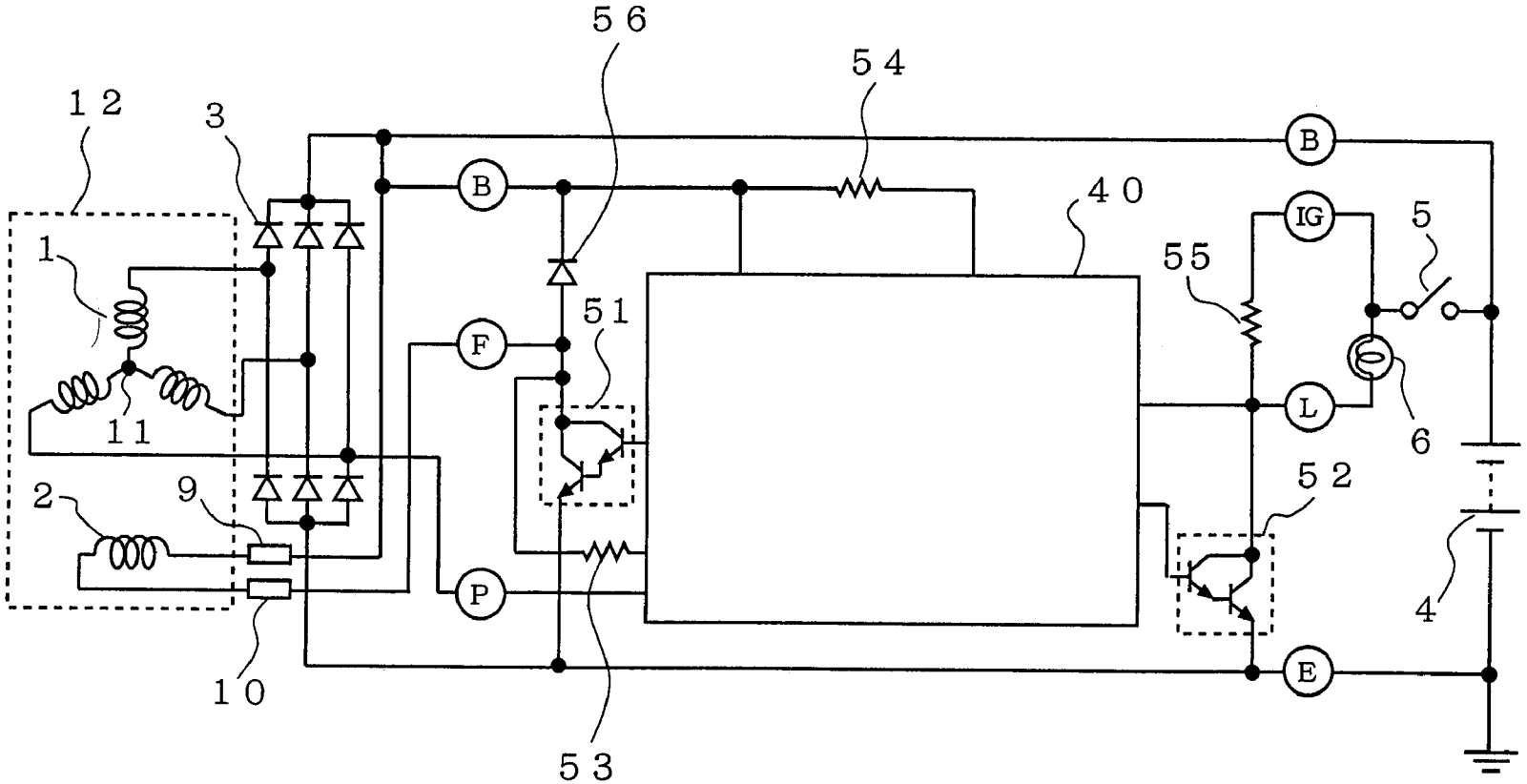
FIG. 1 is a diagram showing an electric circuit arrangement of a brush abrasion detector of a vehicle generator according to a first preferred embodiment.

Several preferred embodiments of a brush abrasion detector of a vehicle generator according to the present invention are hereinafter described with reference to the drawings.

In the drawings, like reference numerals refer to the same or like parts.

Embodiment 1

FIG. 1 is a diagram showing an electric circuit arrangement of a brush abrasion detector of a vehicle AC generator (hereinafter, referred to as vehicle generator) according to a first embodiment of the invention.

In FIG. 1, reference numeral 1 designates an armature winding (stator winding). Numeral 2 designates a field winding (rotator winding). Numeral 3 designates a three-phase full-wave rectifier. Numeral 4 designates a battery. Numeral 5 designates a key switch. Numeral 6 designates a PL (pilot lamp) Numeral 9 designates a brush (+). Numeral 10 designates a brush (−). Numeral 11 designates a neutral point.

Figure 11:
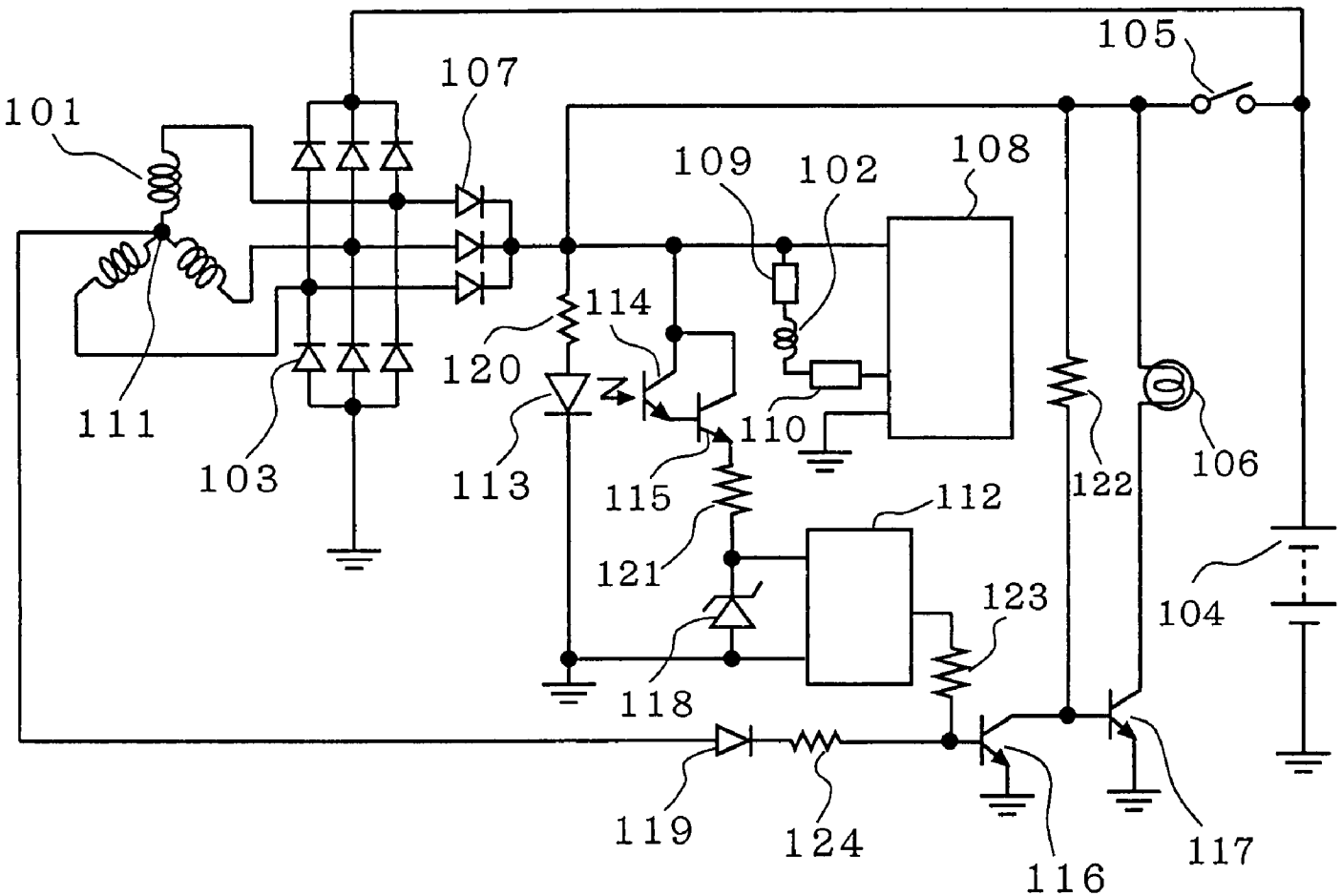
Fig. 11 (PRIOR ART)
FIG. 11 is a diagram showing an electric circuit arrangement of a conventional brush abrasion detector.
Figure 12:
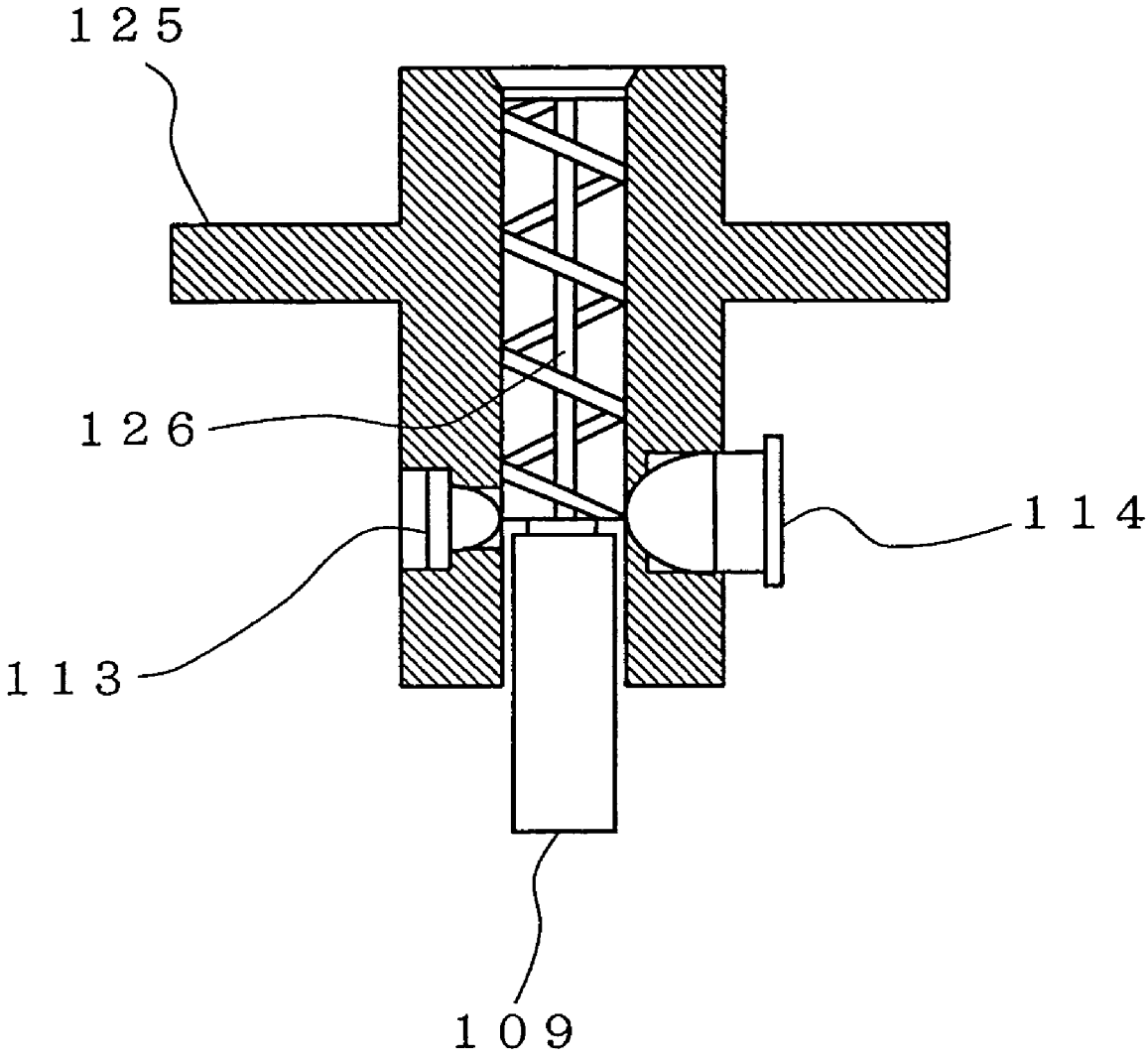
Fig. 12 (PRIOR ART)
FIG. 12 is a view showing a construction of a brush holder used in the conventional brush abrasion detector.

These parts have functions equivalent to those of the armature winding (stator winding) 101, the field winding (rotator winding) 102, the three-phase full-wave rectifier 103, the battery 104, the key switch 105, the PL (pilot lamp) 106, the brush (+) 109, the brush (−) 110, and the neutral point 111, respectively shown in FIG. 11.

In additiion, numeral 12 designates a generator consisting of the armature winding (stator winding) 1, the field winding (rotator winding) 2 and the like.

Numeral 40 designates an integrated circuit that is employed in the brush abrasion detector of a vehicle generator according to this first embodiment, and has functions such as brush abrasion detection, abrasion limit determination, alarm display control, etc.

Figure 2:
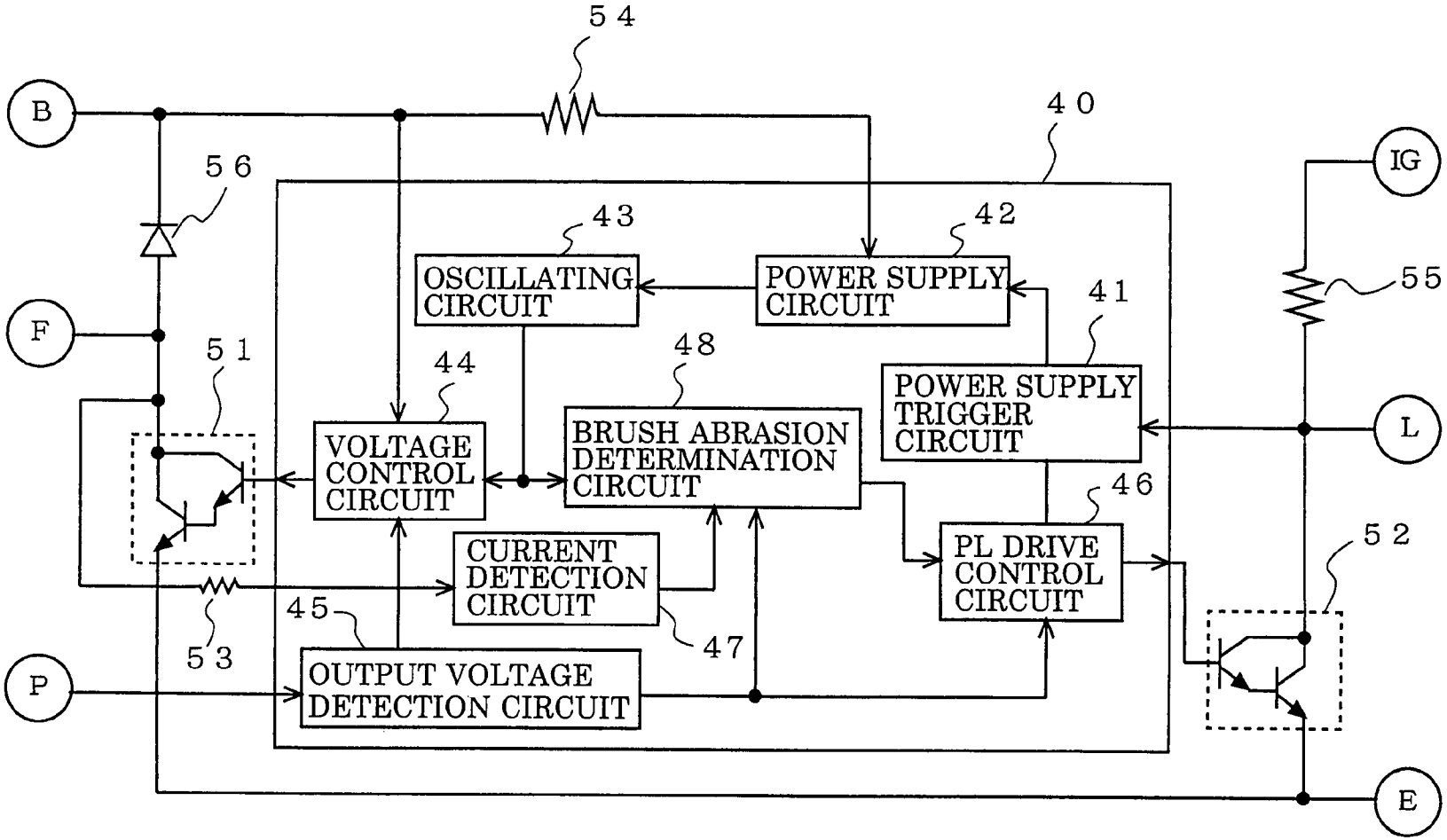
FIG. 2 is a diagram showing an internal arrangement of an integrated circuit shown in FIG. 1.

FIG. 2 is a diagram showing an internal arrangement of the integrated circuit 40, to explain the operation of the integrated circuit 40.

Referring to FIG. 1 or 2, numeral 51 designates a transistor acting as an open/close element for interrupting and controlling an excitation current of the vehicle generator. Numeral 52 designates a power transistor causing the PL (pilot lamp, and hereinafter merely referred to as PL) 6 to light at the time of fault such as no power generation or an over-voltage state of the vehicle generator, as well as causing the PL 6 to flick at the moment of coming to the limit of abrasion of brush.

In addition, numeral 53*a* designates a resistor for restricting detection current. Numeral 54 is a resistor for restricting current so as to prevent a power supply circuit 42 from being damaged when supplying an electric power to the power supply circuit 42 in the integrated circuit 40. Numeral 55 is a resistor for restricting current when supplying an electric power from the battery 4 via the key switch 5. Numeral 56 designates a diode generally known as flywheel diode.

Figure 3:
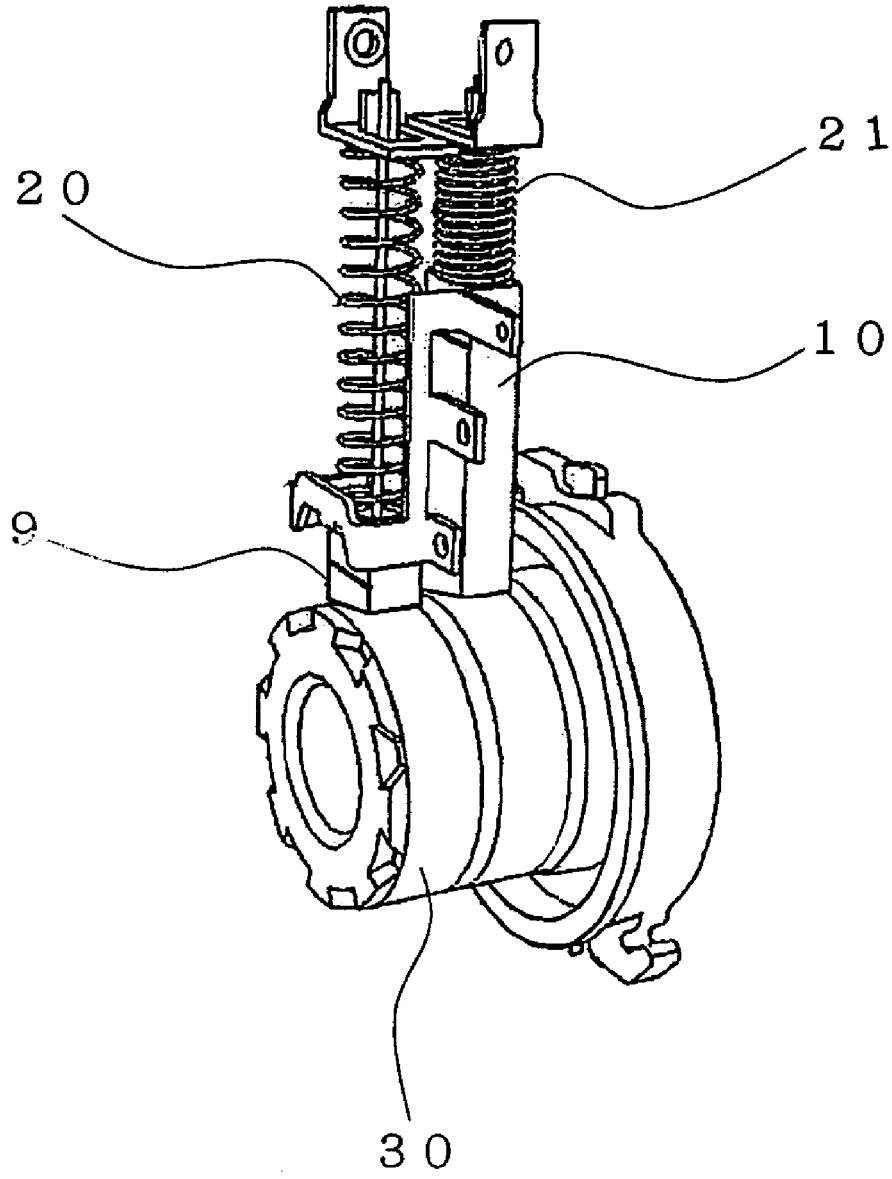
FIG. 3 is a view showing a construction of a feed mechanism section.

FIG. 3 is a perspective view showing a construction of a feed mechanism section to which the brush abrasion detector of a vehicle generator according to the first embodiment is applied.

As shown in FIG. 3, the feed mechanism section consists of a pair of brush (+) 9 and brush (−) 10, and a coil spring 20 and a coil spring 21 applying loads respectively to these brushes.

Further, the brush (+) 9 and the brush (−) 10 of the feed mechanism section applies a contact pressure at all times to a slip ring 30 acting as a section fed with an electric power thus constituting a power feed circuit.

In addition, with reference to FIG. 3, a longer brush (i.e., brush 10) shows a size of the brush in the initial state; and the other shorter (i.e., brush 9) shows a size of the brush immediately before the limit of abrasion.

Although the brushes are shown being different in length so as to be easy to understand, a pair of brush (+) 9 and brush (−) 10 is hardly different largely from each other in abrasion under the condition of a normal use, but they are almost of the same size.

The brush (+) 9 and the brush (−) 10 are located being slidably press-fitted to the slip ring 30 provided at an end portion of the field winding of the generator.

A contact pressure between the slip ring 30 and the brush (+) 9 or brush (−) 10 is mainly a load provided by the coil springs 20 and 21 that is an elastic force. This elastic force conforms to Hooke's law.

Consequently, when the abrasion gets on as the brush (+) 9, the coil spring 20 extends resulting in decrease in elastic force, and a contact pressure between the slip ring 30 and the brush (+) 9 reduces as well.

Figure 4:
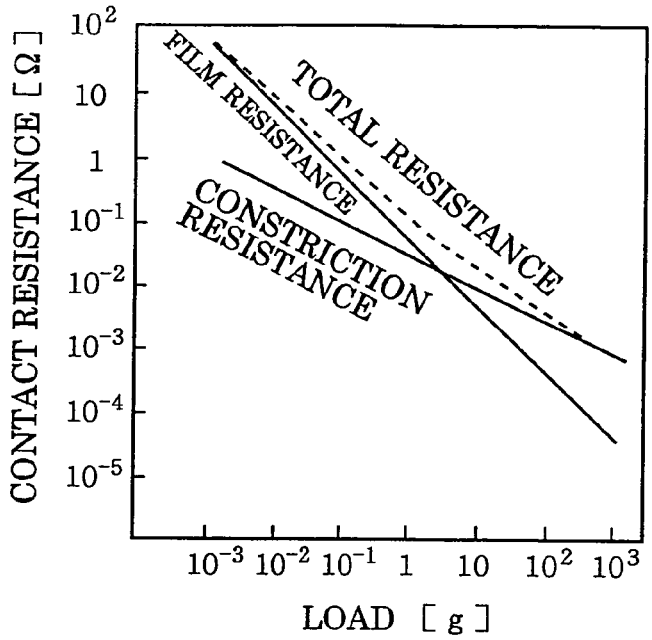
FIG. 4 is a chart showing a relation between contact pressure and contact resistance.

Generally, in the case where current flows through a contact surface of two conductors, supposing an enlarged view, a contact surface is an aggregation of some small contact surfaces. Area or number of points to be in contact increases as a contact pressure gets larger; and a contact resistance decreases as a load (contact pressure) gets larger as shown in FIG. 4 [Revised Electric Material (issued by Corona Publishing Co., Ltd) p64, FIG. 3, 3].

Figure 5:
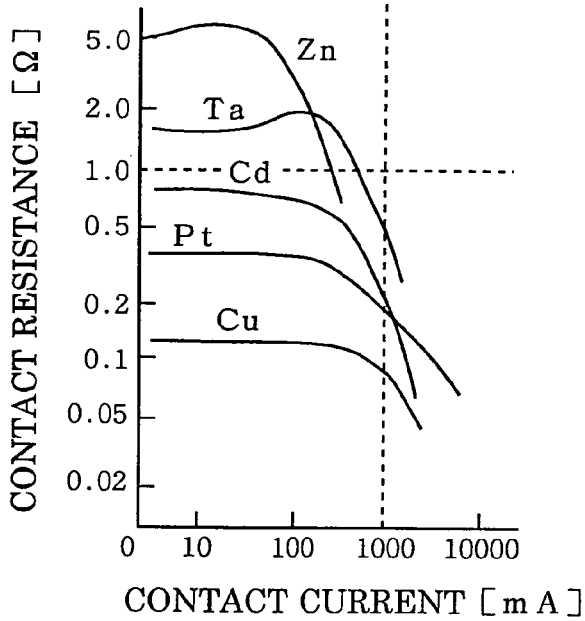
FIG. 5 is a chart showing that a contact resistance varies depending on material of conductor.

In addition, as shown in FIG. 5 [Revised Electric Material (issued by Corona Publishing Co., Ltd) p64, FIG. 3, 4], when materials of the conductors to be brought in contact are different, a contact resistance varies.

In the brush abrasion detector of a vehicle generator according to this first embodiment, decrease in excitation current, which is affected by a contact resistance between the slip ring and the brush at the time of reaching the limit of abrasion of the brush, is determined, and alarm of the limit of abrasion of brush is raised.

Now, operation is described. With reference to FIG. 1, when the key switch 5 is closed, a power supply trigger circuit 41 within the integrated circuit 40, shown in FIG. 2, starts operation, causing a PL drive control circuit 46 to operate and causing the PL 6 to light.

This state is referred to as no-generation alarm state.

At this time, a power supply circuit 42 also operates, and supplies voltage to all circuits of the integrated circuit 40. (In addition, with reference to FIG. 2, the arrows→showing the voltage supply from the power supply circuit 42 are omitted except for that to an oscillating circuit 43.)

Accordingly, the oscillating circuit 43 comes to be in the oscillating state. In response to an input from this oscillating circuit 43, a voltage control circuit 44 brings a transistor 51 in conduction at a constant conductivity in synchronization with a cycle of the oscillating circuit 43.

This state is referred to as initial excitation state (first control state).

Therefore, an excitation current flows to the rotator winding 2 by the control of a constant interruption in the initial excitation state whereby the generator 12 comes to be in the state capable of power generation.

When the rotator winding 2 is made to rotate and drive due to rotation of an engine, not shown, voltage is induced at the armature winding (stator winding) of the three-phase star connection 1.

An output from one phase of the three-phase star connection 1 is inputted to an output voltage detection circuit 45. Then, when this output voltage (that is, voltage to be inputted to the output voltage detection circuit 45) becomes not less than a predetermined threshold, the output voltage detection circuit 45 outputs a signal to a voltage control circuit 44, a PL drive control circuit 46, and a brush abrasion determination circuit 48.

At this time, the voltage control circuit 44 switches from the initial excitation state to the second control mode of controlling open/close of the transistor 51 by comparing a generation voltage and a target voltage of the generator 12.

Further, the PL drive control circuit 46 determines that the generator 12 has reached the power generation state based on having received an input from the output voltage detection circuit 45, and causes the PL 6 to go out.

According to this first embodiment, detection of the abrasion limit of brush is carried out in the case of the initial excitation state in which the generator 12 changes from the no-generation state to the power generation state.

A collector current of the transistor 51, which the current detection circuit 47 measures, is an initial excitation current to be supplied from the battery 4 via the brush (+) 9, the field winding (rotator winding) 2, and the brush (−) 10.

Therefore, when a load of the coil spring 20 or the coil spring 21 decreases due to abrasion of brush and a contact resistance between the brush (+) 9 or brush (−) 10 and the slip ring 30 becomes larger, an excitation current, that is, a collector current of the transistor 51 also decreases as described above.

Then, establishing an average of an interrupted collector current during a constant open/close time period under the initial excitation immediately before the limit abrasion of the brush as a threshold, an average value of a collector current at the time of the initial excitation is measured at all times by the current detection circuit 47. In the case of measuring a current value of not more than the threshold, the brush abrasion determination circuit 48 is brought in ON operation.

At this time, since the generator starts no power generation, the PL 6 remains to light as in the state of no-generation. However, once the brush abrasion determination circuit 48 has started ON operation, the generator having a function to continue this operation causes the PL 6 to flash for the purpose of alarming a vehicle driver after the start of the engine rotation.

These operations make it possible to raise an alarm of the abrasion limit of brush with respect to a vehicle driver.

Figure 6:
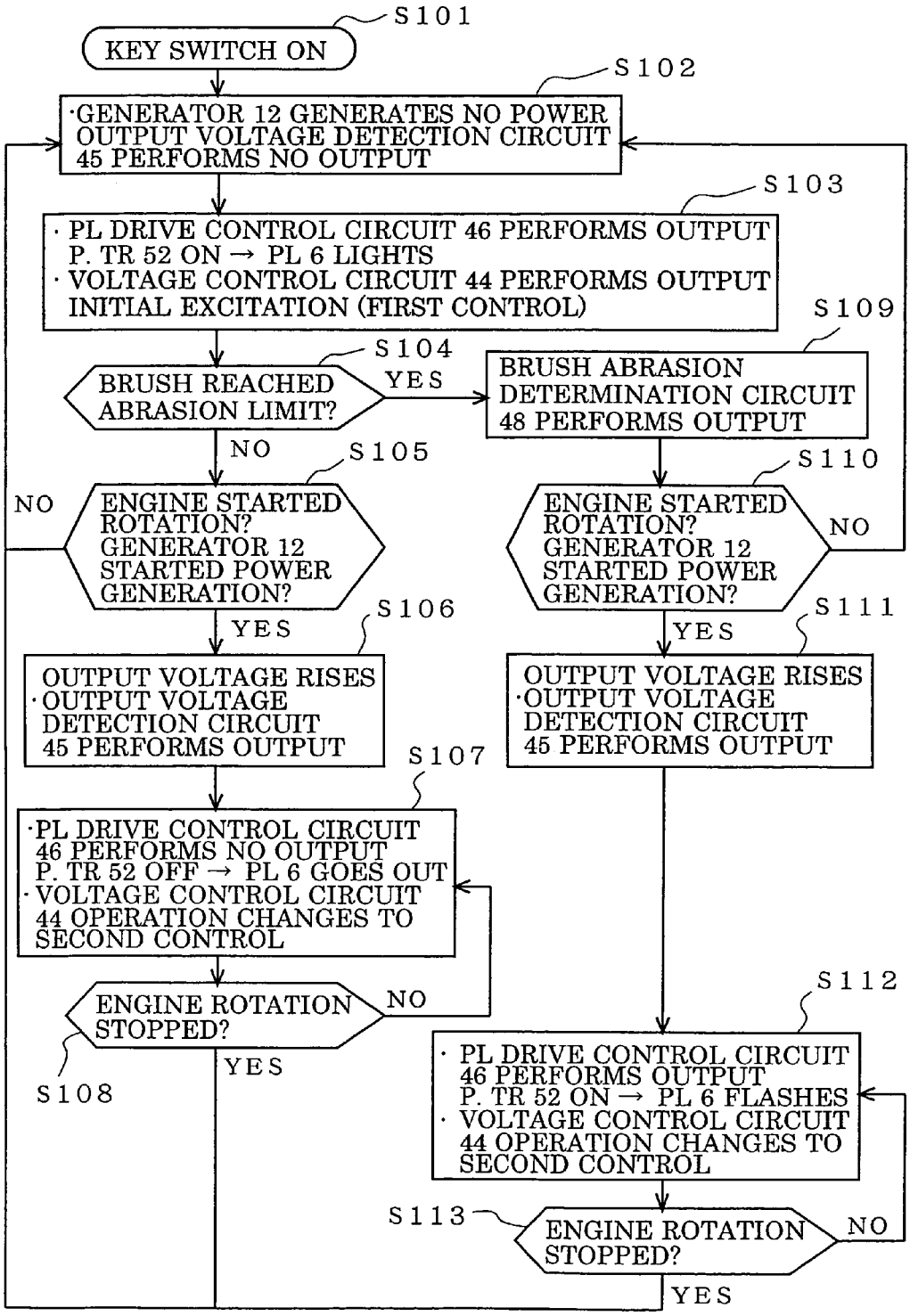
FIG. 6 is a flowchart for explaining operation of the brush abrasion detector of a vehicle generator according to the first embodiment.

FIG. 6 is a flowchart for explaining operation (brush abrasion alarm operation) of the brush abrasion detector of a vehicle generator according to the first embodiment.

Figure 7:
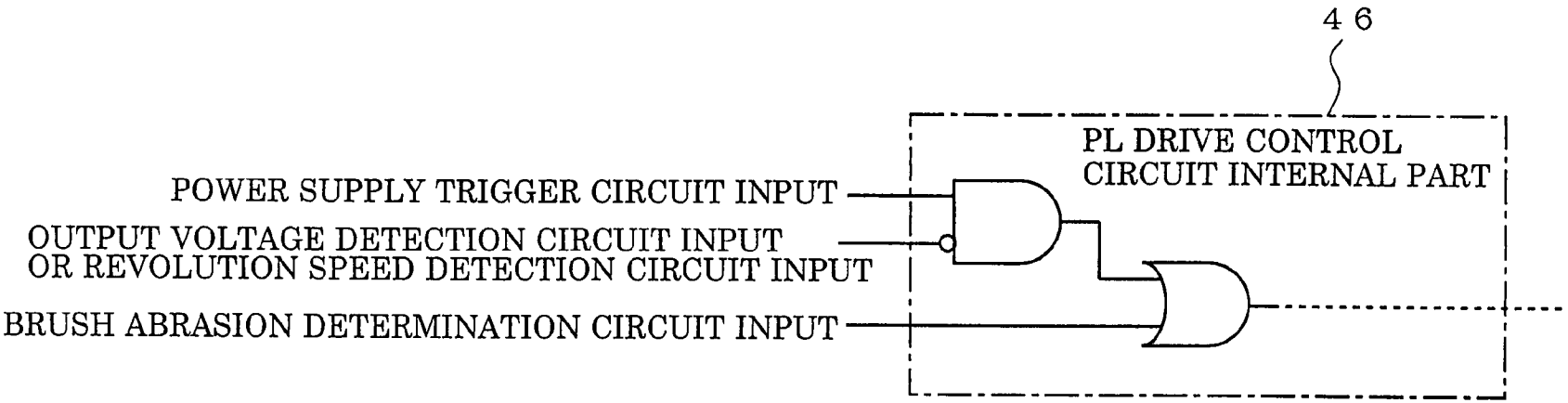
FIG. 7 is a block diagram showing an arrangement of a PL (pilot lamp) drive control circuit and an input signal thereof.

Further, FIG. 7 is a block diagram showing an arrangement of an internal circuit of the PL drive control circuit 46 and signals to be inputted. FIGS. 8 (*a*) and (*b*) are tables showing relations between a state of the key switch 5 (ON/OFF), state of the generator (power generation/no power generation), state of the brush (having reached the limit of abrasion/not reached yet) and state of lighting/light-out of the PL 6 (pilot lamp)

Now, referring to FIG. 6, the operation of the brush abrasion detector of a vehicle generator according to the first embodiment is described.

First, when making the key switch 5 ON (Step S101), the engine rotation is in the sate of being stopped. In the state of no-generation of the generator 12, an input to the output voltage detection circuit 45 is absent, and the output voltage detection circuit 45 performs no output (Step S102).

Since the output voltage detection circuit 45 performs no output, the PL drive control circuit 46 performs an output, a power transistor 52 is made ON, and the PL (pilot lamp) 6 is lighted; and the voltage control circuit 44 performs an output so as to come into the first control operation state (initial excitation state) (Step S103).

Subsequently, the brush abrasion determination circuit 48 determines whether or not the brush has reached the limit of abrasion (Step S104). In the case where the brush has not reached the limit of abrasion, the brush abrasion determination circuit 48 performs no output, and the program proceeds to Step S105. In the case where the brush has reached the limit of abrasion, the brush abrasion determination circuit 48 performs an output (Step S109).

Step S105 and Step S110 are steps from which the program bifurcates depending on whether or not the engine rotation starts and the generator 12 starts the power generation.

In the case where the generator 12 has not started power generation, that is, the generator 12 is in the state of no-generation, the operations of Step S102 and Step S103 are maintained without regard to an output from the brush abrasion determination circuit 48.

When the generator 12 starts the power generation, an output voltage therefrom rises, and the output voltage detection circuit 45 performs an output (Step S106, Step S111).

When the brush has not reached the limit of abrasion yet and the generator 12 is in the state of generation, the brush abrasion determination circuit 48 performs no output, therefore the PL drive control circuit 46 stops the output, and PL (pilot lamp) 6 goes out. Further, to get into the second control operation, the voltage control circuit 44 performs an output (Step S107).

Further, after the brush has reached the limit of abrasion and the generator 12 is in the state of generation, although the output voltage detection circuit 45 performs not output, the PL (pilot lamp) 6 flashes responsive to an output (flickering output) from the brush abrasion determination circuit 48. Furthermore, to get into the second control operation, the voltage control circuit 44 performs an output (Step S112).

Step S108 and Step S113 are steps from which the program bifurcates depending on whether or not the engine rotation is stopped.

In the case where the engine rotation is not stopped in Step S108, the operation of Step S107 is maintained. Further, in the case where the engine rotation is not stopped in Step S113, the operation of Step S112 is maintained.

In the case where the engine rotation is stopped in step S108 or Step S113, the program returns to Step S102 without regard to an output from the brush abrasion determination circuit 48.

As described above, a brush abrasion detector of a vehicle generator according to this first embodiment includes: a brush 9, 10 located being slidably press-fitted to a slip ring 30, which is provided at an end portion of a field winding 2 of a generator 12, and for supplying an excitation current from a battery 4 to the field winding 2; a current detection circuit 47 for detecting a current value flowing through the field winding 2 of the generator 12 via the brush 9, 10; an output voltage detection circuit 45 for detecting an output voltage value from the generator 12; and a brush abrasion determination circuit 48 for determining an abrasion state of the brush based on a current value detected by the current detection circuit 47 or an output voltage value detected by the output voltage detection circuit 45.

Accordingly, a control circuit of a generator has therein a function to detect the limit of abrasion of brush. As a result, it is unnecessary to provide a detecting element for detecting the limit of abrasion of brush in the proximity of the feed mechanism section or the brush itself, thereby enabling to provide a brush abrasion detector of a vehicle generator of a superior productivity at a reasonable cost that needs no machining in order to provide a detecting element.

Furthermore, no detecting element for detecting the limit of abrasion of brush is provided in the proximity of the brush, therefore it is possible to provide a highly reliable brush abrasion detector of a vehicle generator capable of preventing the decrease in reliability of detecting the limit of abrasion of brush caused by scraps or dust of the abrading brush or the accumulation thereof.

In addition, in the above-described embodiment, the case of detecting the decrease in excitation current by measuring a collector current of the transistor 51, is described. However, an equivalent effect can be obtained even if a current value on the emitter side of the transistor 51 is measured.

Further, a collector current of the transistor 51 and an oscillation frequency of the oscillating circuit 43 determining a constant open/close time period of the transistor 51 at the time of the first control, vary depending on temperature.

Therefore, it is possible to obtain an effect of improving operation reliability of the brush abrasion determination circuit 48 by providing, e.g., a temperature sensor and changing a threshold value of the current detection circuit 47 as a current value varies in accordance with the change in temperature.

Further, it is possible to obtain an effect of achieve reduction in collector current of the transistor 51 distinguished by implanting any material having a larger contact resistance in a position of the abrasion limit of brush, or employing a brush possessing a configuration in which contact area with the slip ring 30 is small.

Further, although a bipolar transistor is used as an interruption control element of the control section in this first embodiment, it is preferable to utilize MOSFET.

Embodiment 2

Figure 9:
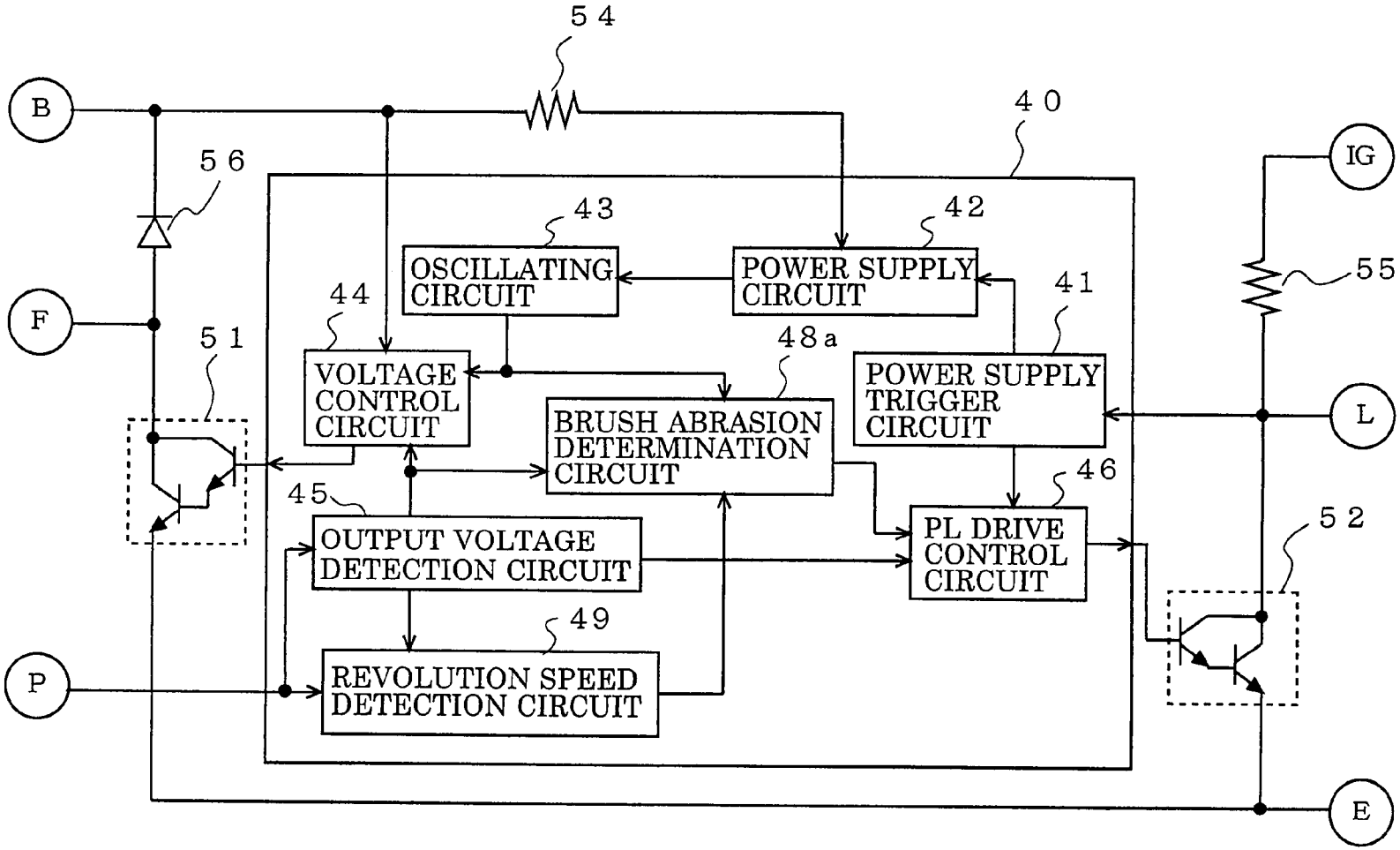
FIG. 9 is a diagram showing an electric circuit arrangement of a brush abrasion detector of a vehicle generator according to a second embodiment.

FIG. 9 is a diagram showing an internal arrangement of an integrated circuit 40*a* for use in a brush abrasion detector of a vehicle generator according to a second embodiment. FIG. 9 also explains operation of the integrated circuit 40*a*.

In the electric circuit arrangement of the brush abrasion detector of a vehicle generator according to this second embodiment, the integrated circuit 40 of FIG. 1 is substituted with the integrated circuit 40*a*.

That is, in the brush abrasion detector of a vehicle generator according to the foregoing first embodiment, the current detection circuit 47 for detecting a collector current of the transistor 51 is provided. However, in this second embodiment, instead of such a current detection circuit, it is a feature that a revolution speed detection circuit 49 for detecting number of revolutions of the rotator winding 2 is provided.

Operation thereof is now described.

The process, in which the key switch 5 (refer to FIG. 1) is closed and the generator 12 comes to be in the state capable of power generation resulted from the initial excitation state, is the same as in the foregoing first embodiment.

Then, the generator 12 starts power generation, and one phase of an output voltage is inputted to the output voltage detection circuit 45. At this time, in this second embodiment, number of revolutions of the generator is also inputted to the revolution speed detection circuit 49 at the same time.

The process, in which when one phase of output voltage becomes not less than a threshold value set at the output voltage detection circuit 45, the voltage control circuit 44 changes from the initial excitation state to the second control mode of controlling open/close of the transistor 51, and the PL drive control circuit 46 causes the PL 6 to go out, is also the same as in the foregoing first embodiment.

In this second embodiment, however, detection of the limit of abrasion of a brush is carried out by measuring number of revolutions of the rotator winding 2 at the moment of switching from first control means to second control means.

A contact resistance with the slip ring 30 increases due to decrease in load provided by the coil springs 20, 21 (refer to FIG. 3) accompanied by the abrasion of brush, and therefore an excitation current flowing through the rotator winding 2 reduces and power generation provided by the generator 12 also reduces.

Accordingly, a larger number of revolutions are required so that one phase of output voltage may reach a threshold of the output voltage detection circuit 45.

Then, establishing the number of revolutions of the rotator winding at the time of switching from the first control to the second control immediately before the limit of abrasion of brush as a threshold value, changing number of revolutions is measured at all times by the revolution speed detection circuit 49. In the case of measuring a number of revolutions of not less than a threshold value, the brush abrasion determination circuit 48*a* performs ON operation.

Since the foregoing ON operation functions to hold, the PL 6 remains to light at the time when the generator 12 generates no electric power. However, the process, in which the PL 6 is brought in flickering for the purpose of raising the alarm to a vehicle driver after the start of engine rotation, is the same as in the foregoing first embodiment.

Thus, these operations make it possible to raise an alarm of the limit of abrasion of brush to a vehicle driver.

Figure 10:
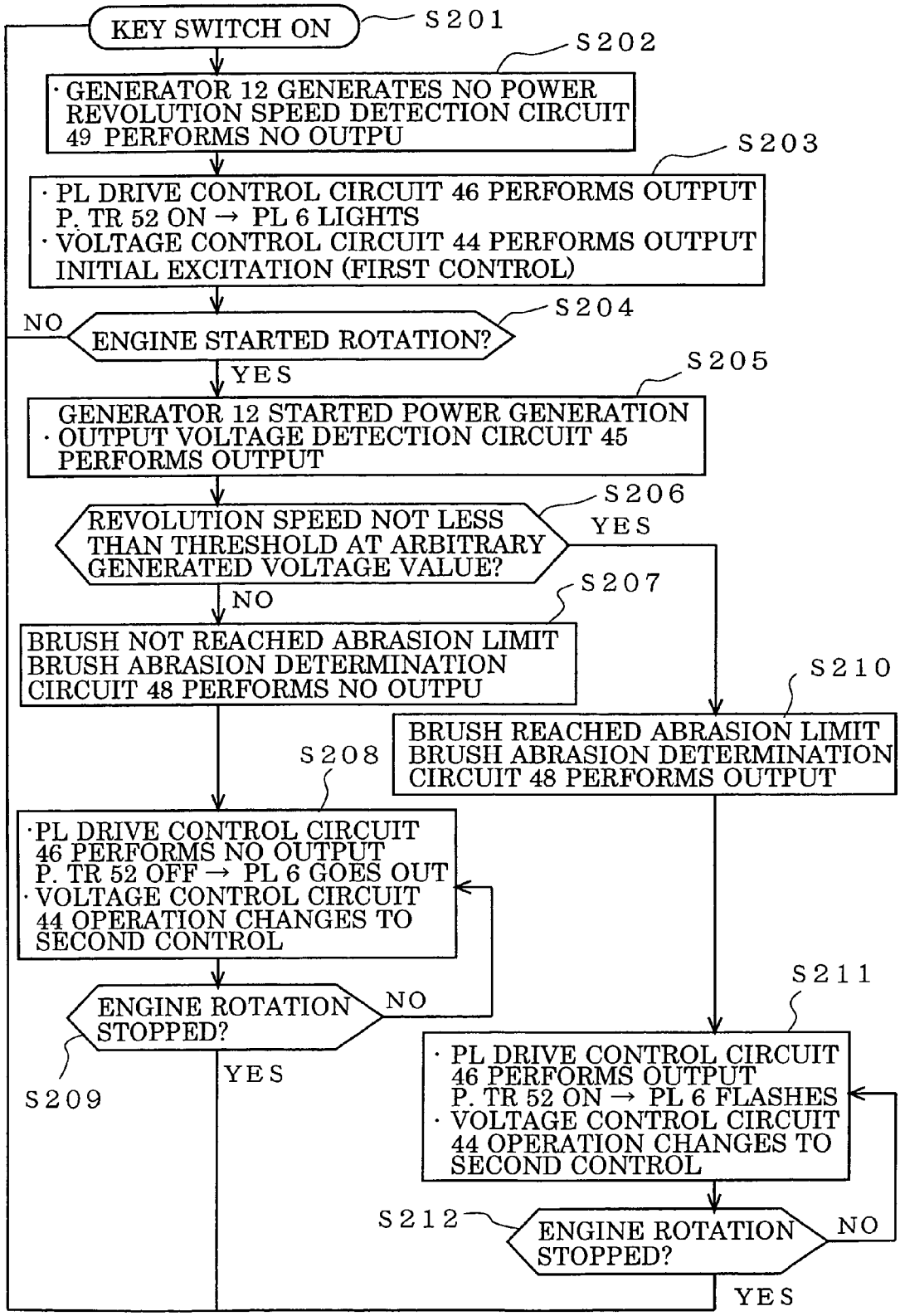
FIG. 10 is a flowchart for explaining operation of the brush abrasion detector of a vehicle generator according to the second embodiment.

FIG. 10 is a flowchart for explaining the operation (brush abrasion alarm operation) of the brush abrasion detector of a vehicle generator according to the second embodiment.

In addition, arrangement of an internal circuit of the PL drive control circuit 46 and signals to be inputted are the same as those shown in FIG. 7. Relations between a state of the key switch 5 (ON/OFF), state of the generator (power generation/no power generation), state of the brush (having reached the limit of abrasion/not reached yet), and state of lighting/light-out of the PL (pilot lamp) 6 are also the same as those shown in FIG. 8.

The operation of the brush abrasion detector of a vehicle generator according to this second embodiment is described with reference to FIG. 10.

First, when turning the key switch 5 ON (Step S201), an engine is in the sate of the rotation being stopped. In the state of no generation of the generator 12, there is no input to the output voltage detection circuit 45, and the output voltage detection circuit 45 performs no output (Step S202).

Since the output voltage detection circuit 45 performs no output, the PL drive control circuit 46 performs an output, the power transistor 52 becomes ON, and the PL 6 is brought in lighting. In addition, the voltage control circuit 44 performs an output so as to be in a first control operation state (initial excitation state) (Step S203).

Step S204 is a step from which the program bifurcates depending on whether or not the engine rotation has started. In the case where the engine rotation has not started, operations of Step S202 and Step S203 are maintained.

In the case where the engine rotation has started, an output voltage rises as the engine rotation increases, and the output voltage detection circuit 45 performs an output (Step S205).

Step S206 is a step from which the program bifurcates depending on whether or not number of revolutions is not less than a predetermined threshold at an arbitrary generated voltage value. When number of revolutions is less than a threshold value, the brush abrasion determination circuit 48*a* determines that the brush has not reached the limit of abrasion yet, and the brush abrasion determination circuit 48*a* performs no output (Step S207).

Then, after the brush has reached the limit of abrasion and in the state that the generator 12 has started the power generation, since the output voltage detection circuit 45 performs no output, an output from the PL drive control circuit 46 is stopped, the power transistor 52 is not ON, and the PL 6 goes out. Further, to get into a second control operation, the voltage control circuit 44 performs an output (Step S208).

On the other hand, when number of revolutions is not less than a threshold in Step S206, the brush abrasion determination circuit 48*a* determines that the brush has reached the limit of abrasion, and the brush abrasion determination circuit 48*a* performs an output (flickering) (Step S210).

Then, after the brush has reached the limit of abrasion and in the state in which the generator 12 has started the power generation, although the output voltage detection circuit 45 performs no output, an output (flickering output) from the brush abrasion determination circuit 48*a* causes the PL drive control circuit 46 to drive, and causes the power transistor 52 to be ON/OFF resulting in flickering of the PL 6. Further, to get into the second control operation, the voltage control circuit 44 performs an output (Step S211).

Step S209 and Step S212 are a step from which the program bifurcates depending on whether or not the engine rotation is stopped.

In the case where the engine rotation is not stopped in Step S209, the operation of Step S208 is maintained. In the case where the engine rotation is not stopped in Step S212, the operation of Step S211 is maintained.

When the engine rotation is stopped in Step S209 and Step S212, the program returns to Step S202 without regard to an output from the brush abrasion determination circuit 48.

As described above, a brush abrasion detector of a vehicle generator according to this second embodiment includes: a brush 9, 10 located being slidably press-fitted to a slip ring 30, which is provided at an end portion of a field winding 2 of a generator 12, and for supplying an excitation current from a battery 4 to the field winding 2; a revolution speed detection circuit 49 for detecting number of revolutions of the generator 12; and a brush abrasion determination circuit 48*a* for determining abrasion state of the brush based on the number of revolutions detected by the revolution speed detection circuit 49.

Accordingly, a control circuit section of a generator has therein a function to detect the limit of abrasion of a brush in the same manner as the brush abrasion detector of a vehicle generator according to the foregoing first embodiment. As a result, it is unnecessary to provide a detecting element for detecting the limit of abrasion of brush in the proximity of the feed mechanism section or at the brush itself, thereby enabling to provide a brush abrasion detector of a vehicle generator of a superior productivity at a reasonable cost that needs no machining in order to provide a detecting element. In addition, no detecting element for detecting the limit of abrasion of brush is provided in the proximity of the brush, and therefore it is possible to prevent the decrease in reliability of detecting the limit of abrasion of brush caused by scrap or dust of the abrading brush or the accumulation thereof.

In addition, it is also preferable that the revolution speed detection circuit 49 employs a F-V conversion circuit constituted of, for example, a differentiating circuit and integrating circuit, and that the brush abrasion determination circuit 48 is brought in operation in the case where a voltage value having been converted is not less than a threshold.

Further, it is also preferable to establish a revolution speed as a threshold value at the moment of switching to the second control mode. In this case, by causing the output voltage detection circuit 45 to measure one phase of output voltage at the time of switching from the first control to the second control, an output voltage at a revolution speed of switching to the second control immediately before the limit of abrasion of brush is established as a threshold value. Even in the case of measuring an output value of not more than a threshold, an equivalent effect can be obtained.

Further, in the same manner as in the foregoing first embodiment, it is also preferable that temperature sensor or the like is provided to change a threshold value of a revolution speed detection circuit and an output voltage detection circuit for the purpose of improving operation reliability. Furthermore, it is possible to obtain an effect of achieve reduction in collector current of the transistor 51 distinguished by implanting any material having a larger contact resistance in a position of the abrasion limit of brush, or employing a brush possessing a configuration in which contact area with the slip ring 30 is small.

While the presently preferred embodiments of the present invention have been shown and described.

It is to be understood that these disclosures are for the purpose of illustration and that various changes and modifications may be made without departing from the scope of the invention as set forth in the appended claims.

What is claimed is:

1. A brush abrasion detector of a vehicle generator comprising:

a brush that is located being slidably press-fitted to a slip ring to create a contact resistance, which is provided at an end portion of a field winding of a generator, and supplies an excitation current from a battery to said field winding;

a current detection circuit for detecting a current value flowing through said field winding of the generator via said brush, said current value corresponding to the contact resistance;

an output voltage detection circuit for detecting an output voltage value from the generator, said output voltage value corresponding to the contact resistance; and a brush abrasion determination circuit for determining an abrasion state of said brush based on said current value detected by said current detection circuit or said output voltage value detected by said output voltage detection circuit.

2. The brush abrasion detector of a vehicle generator according to claim 1, wherein current interruption control means for interrupting and controlling a current flowing through said field winding depending on whether or not an output voltage from the generator is larger than a target value is provided; and said brush abrasion determination circuit determines an abrasion state of said brush based on an average value of interrupted current detected by said current detection circuit.

3. The brush abrasion detector of a vehicle generator according to claim 1, wherein a material having a large contact resistance is implanted in said brush at a portion of the limit of abrasion.

4. The brush abrasion detector of a vehicle generator according to claim 2, wherein a material having a large contact resistance is implanted in said brush at an abrasion limit portion.

5. The brush abrasion detector of a vehicle generator according to claim 1, wherein said brush comprises a brush abrasion limit portion which possesses such a configuration that a contact area with the slip ring becomes smaller.

6. The brush abrasion detector of a vehicle generator according to claim 2, wherein said brush comprises a brush abrasion limit portion which possesses such a configuration that a contact area with the slip ring becomes smaller.

7. A brush abrasion detector of a vehicle generator comprising: a brush that is located being slidably press-fitted to a slip ring, which is provided at an end portion of a field winding of a generator, and supplies an excitation current from a battery to said field winding; a revolution speed detection circuit for detecting the number of revolutions of said generator at a time when the generator is generating power; and a brush abrasion determination circuit determining an abrasion state of said brush based on the number of revolutions detected by said revolution speed detection circuit.

8. The brush abrasion detector of a vehicle generator according to claim 7, wherein a material having a large contact resistance is implanted in said brush at a portion of the limit of abrasion.

9. The brush abrasion detector of a vehicle generator according to claim 7, wherein said brush comprises a brush abrasion limit portion which possesses such a configuration that a contact area with the slip ring becomes smaller.

10. The brush abrasion detector of a vehicle generator according to claim 7, wherein said excitation current is supplied to said field winding when the revolution speed detection circuit detects the number of revolutions.

11. The brush abrasion detector of a vehicle generator according to claim 7, wherein determining the abrasion state includes detecting an increase in the number of revolutions which are needed to reach a threshold of an output voltage detection circuit.

12. The brush abrasion detector of a vehicle generator according to claim 7, wherein the abrasion state of said brush is determined when switching from an initial excitation state to a control mode wherein the excitation current is interrupted and controlled.

13. A brush abrasion detector of a vehicle generator comprising:

a brush that is located being slidably press-fitted to a slip ring, which is provided at an end portion of a field winding of a generator, and supplies an excitation current from a battery to said field winding;

a current detection circuit for detecting a current value flowing through said field winding of the generator via said brush;

an output voltage detection circuit for detecting an output voltage value from the generator;

a brush abrasion determination circuit for determining an abrasion state of said brush based on said current value detected by said current detection circuit or said output voltage value detected by said output voltage detection circuit, wherein current interruption control means for interrupting and controlling a current flowing through said field winding depending on whether or not an output voltage from the generator is larger than a target value is provided, and said brush abrasion determination circuit determines an abrasion state of said brush based on an average value of interrupted current detected by said current detection circuit.

14. The brush abrasion detector of a vehicle generator according to claim 13, wherein a material having a large contact resistance is implanted in said brush at an abrasion limit portion.

15. The brush abrasion detector of a vehicle generator according to claim 13, wherein said brush comprises a brush abrasion limit portion which possesses such a configuration that a contact area with the slip ring becomes smaller.

* * * * *